United States Patent [19]

Kenner

[11] 4,182,931

[45] Jan. 8, 1980

[54] 360 DEGREE SPEAKERS

[76] Inventor: Samuel K. Kenner, 4104 52nd St. #3, San Diego, Calif. 92105

[21] Appl. No.: 900,036

[22] Filed: Apr. 25, 1978

[51] Int. Cl.[2] ..... H04R 1/26

[52] U.S. Cl. ..... 179/1 E; 181/144; 181/155

[58] Field of Search ..... 179/1 E, 115.5 PS, 116; 181/144, 145, 146, 147, 148, 155, 199

[56] References Cited

U.S. PATENT DOCUMENTS

| | | | |
|---|---|---|---|
| 1,820,956 | 9/1931 | Von Arco | 181/148 |
| 2,832,843 | 4/1958 | Miessner | 179/180 |
| 3,076,520 | 2/1963 | Farwell | 181/145 |
| 3,393,764 | 7/1968 | Schafer | 179/1 E |
| 3,866,710 | 2/1975 | Cesati | 181/152 |

FOREIGN PATENT DOCUMENTS

| | | | |
|---|---|---|---|
| 2052045 | 4/1972 | Fed. Rep. of Germany | 179/1 E |
| 2251178 | 5/1974 | Fed. Rep. of Germany | 179/1 E |
| 172174 | 7/1960 | Sweden | 179/115.5 PS |

*Primary Examiner*—George G. Stellar

*Attorney, Agent, or Firm*—Nilsson, Robbins, Dalgarn, Berliner, Carson & Wurst

[57] ABSTRACT

A 360 degree, in-phase audio propagation system utilizating sound propagation in conjunction with various types of active reflectors. In a first embodiment two bass speakers or woofers are mounted in an air-tight casing, the first speaker being mounted internal to the casing and facing outwardly through an aperture, the second speaker being mounted colinear with the first speaker. The casing is supported so that the first speaker is spaced from the floor facing downwardly whereby sound is reflected in a 360 degree pattern from the floor. The two speakers are driven out of phase with each other so that air within the chamber is alternately compressed and rarefied in accordance with a speaker driving signal, thereby preventing either speaker from resonating or overreacting to the driving signal. Sound from the front of the first speaker combines with and is reinforced by sound from the back of the second speaker thereby providing essentially a 360 degree propagation pattern. In one embodiment the second speaker is mounted so as to face the back side of the first speaker. In a further embodiment two dome-type speakers face each other and are spaced a predetermined distance apart. The compressed and rarefied air created by the speaker surfaces interreacts so that sound energy is propagated laterally or normally with respect to the longitudinal axes of the speakers, thereby providing a 360 degree, in-phase propagation pattern having clarity and imaging characteristics heretofore unobtainable by conventional systems. Also, there is found a greater vertical dispersion of the higher frequencies as the confronting dome surfaces of the drivers approach, or contact, one another.

3 Claims, 9 Drawing Figures

360 DEGREE SPEAKERS

FIELD OF THE INVENTION

This invention relates to audio speaker systems and specifically to audio speaker systems having a 360 degree, in-phase dispersion pattern.

BACKGROUND AND SUMMARY OF THE INVENTION

A need for 360 degree propagation of sound energy by a sound reproduction system is essential if realistic reproduction of live sound propagation is to be effected. Virtually all live sources of music propagate sound as if a pebble were dropped in a three-dimensional pool. Many instruments and even human voices propagate with a greater intensity in the forward direction than in other directions. However, energy contributing to quality and loudness is propagated in all directions and arrives at a listener as reflections. The phase relationships of these direct and reflected sound waves allow a listener to locate a sound source respective its location. Many manufactures have attempted 360 degree propagation in a horizontal plane; the need for vertical 360 degree dispersion has not been demonstrated. Some have attempted 360 degree propagation by aiming a plurality of speakers in a plurality of directions about a circle. Some systems have placed all but one speaker facing backwards in order to reflect sound energy from a back wall, thereby attemping to achieve a 360 degree effect. In all of these systems, sound from each source is initiated out-of-phase with respect to sound from the other sources due to the physical displacement of each speaker with respect to the other. All sound waves initiated by a live sound source are by definition in phase. It is this phase relationship that a good sound system tries to accurately reproduce. One way of accomplishing this is to effect 360 degree, in-phase propagation at a sound source, but in practice the desired high level of realism is not achieved.

A speaker system of the present invention provides a 360 degree propagation which does achieve a high level of realism by utilizing any of various types of active reflectors.

In one aspect of the invention, a first dome-type speaker having a longitudinal axis is positioned so that its longitudinal axis is normal to a surface spaced so as to provide an active reflector for sound propagated by the first speaker at a point touching the surface to less than two inches spaced therefrom. The spacing limitations respecting the active reflector are critical to both vertical dispersion and sound pressure level as well as horizontal dispersion. Within the spacing constraint of two inches, a dramatic increase in sound pressure level and excellent horizontal and vertical dispersion is observed at distances corresponding to one-quarter wavelength of the input sine wave, but even at touching (or even at a somewhat negative distance, i.e., compression) a marked improvement in these parameters is found compared to available speakers. In particular, there is found a radical increase in vertical dispersion of the higher frequencies (i.e., greater than 3000 Hertz) as the spacing is decreased to touching.

In accordance with the principles of the invention, the reflecting surface could be a plane surface, a parabolic surface focused at a point within the prescribed distance, or a second dome-type speaker, the two speakers being driven in phase with each other and oriented so that their longitudinal axes are colinear. A speaker system as above described results in sound waves propagated from the first dome speaker interacting with sound waves coming from the second surface so as to produce a 360 degree, in phase propagation pattern normal to the longitudinal axis of the first speaker. The speakers could be oriented so that their longitudinal axes are not colinear, thereby providing a system having directional propagation characteristics while still maintaining the advantages of in-phase propagation.

According to another aspect of the invention, an audio speaker system comprises a first speaker having a forward sound propagating surface and a second speaker having a forward sound propagating surface, each speaker being oriented so that their forward surfaces face each other, and operating means for driving the first and second speakers simultaneously. The speakers are placed sufficiently close to each other so that sound energy propagated from one interacts with sound energy propagated from the other, thereby providing 360 degree, in-phase propagation. If the speakers are mounted so that their longitudinal axes are colinear, then the 360 degree sound propagation will be substantially normal to the longitudinal axes. In a specific embodiment, two dome-type speakers, which could be either mid-range speakers or high frequency speakers (tweeters), are oriented so that the domes are facing each other, and touching or spaced from each other no greater than two inches in the case of the mid-range and one inch in the case of the tweeter. More specifically, a distance from touching to two inches in the general range, from a frequency of 250 Hertz to 20,000 Hertz, whereas for speakers operating in the range of 1000–20,000 Hertz, the distance is preferably from touching to one inch.

The two speakers are driven in phase with each other so that sound waves from each act as an active reflector for sound waves of the other. The alternate compressing and rarefying of air contained between the two closely adjacent speakers provides an in-phase, 360 degree outwardly propagating sound wave having clarity and imaging characteristics heretofore unobtainable in conventional speaker systems.

According to a further embodiment of the invention, an audio speaker system, which in the below-described embodiment has been found to be particularly useful with respect to a bass speaker system, utilizes a casing having a first and second aperture. A first speaker having front and rear sound propagating surfaces is positioned internal to the casing so that its front surface faces outwardly through the first aperture. It is mounted in sealing contact with the first aperture, its rear surface being in reactive contact with an air chamber partially defined by the casing. A second speaker also having front and rear sound propagating surfaces is positioned over the second aperture so that its front surface faces into the air chamber and is in reactive contact therewith, its rear surface facing outwardly from the casing. The two speakers can be mounted so that their longitudinal axes are colinear. The casing and the two speakers define a substantially air-tight chamber. The first speaker and second speaker are driven by the same source, each being driven 180 degrees out-of-phase with respect to the other. The case can be spaced apart from a floor so that the first speaker is directed downwardly, thereby resulting in propagation from the rear surface of the second speaker having a slightly broader frequency propagation spectrum than that of the first speaker floor reflected spectrum due to selective higher frequency absorption by most floor surfaces. This reflected sound combines with sound propagated from the rear face of the second loud-speaker, thereby providing a 360 degree propagation system. The two speakers can be woofers, and when oriented according to the invention as above-described, provide 360 degree propagation of sound between 200 Hz and 600 Hz, frequencies below 200 Hz being generally considered non-directional. Since the air chamber is substantially air-tight, one can appreciate that a 180 degree phase mismatch between the two speakers will result in air within the chamber being alternately compressed and rarefied, each speaker extending inwardly into the chamber at the same time and extending outwardly from the chamber at the same time. It is this constant compression and rarefaction that prevents resonances and speaker over-excursions frequently experienced by conventional speaker systems. The 180 degree phase mismatch also results in back emf generated by each speaker canceling that of the other speaker at the driving source, thereby eliminating undesirable reflections from entering the driving source. The 360 degree propagation of this speaker system combined with the tendency of the closed air chamber to prevent unwanted speaker excursions, provides a realism heretofore unobtainable by conventional speaker systems.

In a further aspect of the invention, the two woofers as previously described are combined in a speaker system containing two mid-range dome-type speakers oriented as above-described and two tweeter dome-type speakers also oriented as above described, so that the longitudinal axes of all speakers are colinear with respect to each other. This speaker system provides 360 degree, in-phase sound propagation having clarity and imaging characteristics heretofore unobtainable by conventional systems.

DETAILED DESCRIPTION

As required, detailed illustrative embodiments of the invention are disclosed herein. These embodiments exemplify the invention and are currently considered to be the best embodiments for such purposes. However, it is to be recognized that other speaker configurations and phase relationships could be utilized in conjunction with the principle of achieving 360 degree, in-phase propagation by active reflectors. Accordingly, the specific embodiments disclosed are representative in providing a basis for the claims which define the scope of the present invention.

As previously explained, the invention discloses various speaker systems in which an active reflective means is utilized to propagate sound energy outwardly. In a first embodiment of the invention two bass speakers are utilized and mounted in a case so that their longitudinal or symmetry-defining axes are colinear, the case and speakers defining a substantially air-tight chamber. The speakers are positioned so that one faces outwardly from the case and one faces inwardly into the case, each speaker being in reactive contact with air within the chamber. The speakers are operated 180 degrees out of phase with each other so that air within the chamber is alternately compressed and rarefied. This alternate compression and rearefaction prevents the speakers from resonating or overreacting to input signals, thereby more accurately reproducing relatively low frequency input signals.

Figure 1:
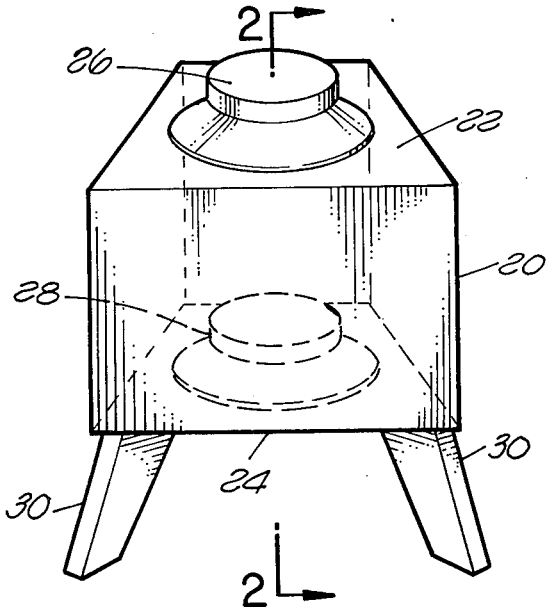
FIG. 1 is a perspective view of a speaker system configured according to a first embodiment of the invention.
Figure 2:
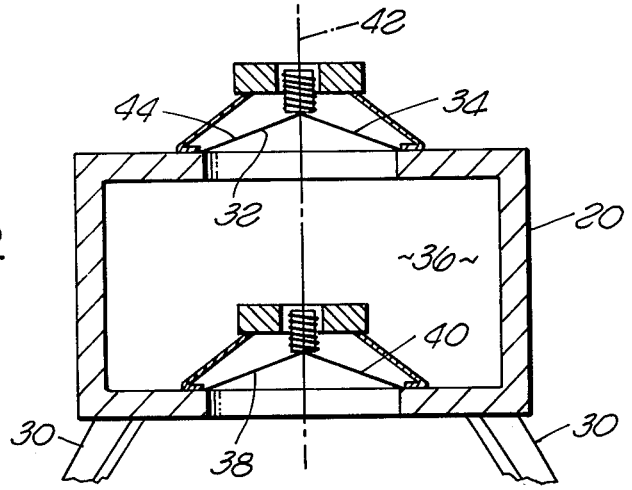
FIG. 2 is a cross sectional view taken along lines 2—2 of FIG. 1.

Referring to FIG. 1, a case in the form of a cube 20 is provided, the cube 20 having an aperture formed in an upper face 22 and a lower face 24. An upper speaker 26 is mounted in sealing contact with the upper aperture and a lower speaker 28 is sealing contact with the lower aperture. Legs 30 are provided to raise the lower speaker 28 from a floor, thereby allowing sound propagated from the speaker 28 to be reflected downwardly to and upwardly from the floor. It is felt that this particular mounting arrangement is especially useful when the upper and lower speakers 26 and 28 are bass speakers or woofers. In a first embodiment the speakers are mounted as shown in FIG. 2 whereby the front surface 32 of the upper speaker diaphragm 34 faces into an air chamber 36 partially formed by the cube 20, and the front surface 38 of the lower speaker diaphragm 40 faces outwardly from the air chamber 36. The cube 20, upper speaker 26 and lower speaker 28 are constructed and mounted so that the air chamber 36 is substantially air-tight. The upper and lower speakers 26 and 28 are oriented so that their longitudinal axes are substantially colinear as shown at 42, although angled longitudinal axes could be utilized to achieve special effects. As one can appreciate by referring to the two speakers 26 and 28 shown in FIG. 2, if their respective diaphragms 34 and 40 move at the same frequency but in a 180 degree out-of-phase relationship with respect to each other, then the upper diaphragm 34 will be at its furthest excursion point into the chamber 36 at the same time that the lower diaphragm 40 is at its furthest excursion into the air chamber 36. At this point the air contained within the chamber 36 will be compressed slightly with respect to an ambient pressure. Likewise, when the speaker 26 is driven so that the upper speaker diaphragm 34 is at its furthest excursion outwardly from the air chamber 36, and the lower speaker diaphragm 40 is also at its furthest excursion outwardly from the air chamber 36, then the air within the chamber 36 will be rarefied with respect to the ambient pressure. Therefore as the two speakers 26 and 28 are driven in a 180 degree phase relationship to each other, air contained within the air chamber 36 will be alternately compressed and rarefied in accordance with movement of the speaker diaphragms 34 and 40. It is this alternate compression and rarefaction that causes the speakers 26 and 28 to perform in an optimum manner by preventing the diaphragms from either resonating or over-responding to driving signals, the compressed air acting as a reactive barrier to inward excursions and the rarefied air acting as a reactive barrier to outward excursions. Conventional speakers, on the other hand, tend to be noisy and sometimes have a "booming" characteristic due to over-excursion of the diaphragm because of resonances, etc. Thus the enclosed air within the chamber 36 acts as a damper at both excursion extremes of the speaker diaphragms 34 and 40, the rarefied air tending to draw the diaphragms 34 and 40 back into the chamber 36, and the compressed air tending to push the diaphragms 34 and 40 outwardly from the chamber 36. Listener directed sound waves produced by this system propagate from the front surface 38 of the lower speaker diaphragm 40 and the rear surface 44 of the upper speaker diaphragm 34. Soundwaves propagated in the chamber 36 as a result of movement of the diaphragms 34 and 40 tend to cancel each other and generally are not perceptable to a listener. Although a cube 20 has been shown for the chamber 36 enclosure, other shapes could be utilized such as a rectangular case, cylindrical case, octagonal case, etc. In addition, the case could be adapted to support a plurality of additional speakers, each being either in phase or 180 degrees out of phase with one of the first pair of speakers 26 and 28.

Figure 3A:
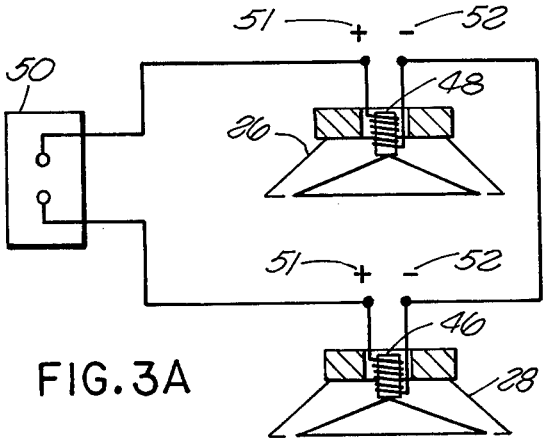
FIGS. 3A and 3B are schematic diagrams showing wiring embodiments for the speakers shown in FIG. 2.

In order for the speaker system to perform as above described, it is necessary that the two speakers 26 and 28 be wired so that their diaphragms move 180 degrees out-of-phase with each other, that is, as the lower speaker diaphragm 40 is moving away from its driver 46 the upper speaker diaphragm 34 is moving towards its driver 48. There are two ways in which the speakers can be wired with respect to a driving source 50 in order to achieve this 180 degree phase relationship. Referring to FIG. 3A, if the upper speaker driver 48 is wired in series with the lower speaker driver 46 so that the positive terminals of each drive 46 and 48 are connected across the output terminals of the driving source 50, then the two speakers 26 and 28 will operate 180 degrees out-of-phase with each other and in accordance with the desired method of operation above described. As can be seen, each speaker 26 and 28 has a positive input terminal as indicated at 51 by a cross and a negative input terminal as indicated at 52 by a minus. A positive signal across the plus and minus terminals will always cause the drivers 46 and 48 to deflect their respective diaphragms in the same direction. Therefore, a positive voltage applied to the positive terminal 51 of the upper speaker 26 and a positive voltage applied to the negative terminal 52 of the lower speaker 28 will cause the diaphragms 34 and 40 of the two speakers to move oppositely with respect to each other.

Figure 3B:
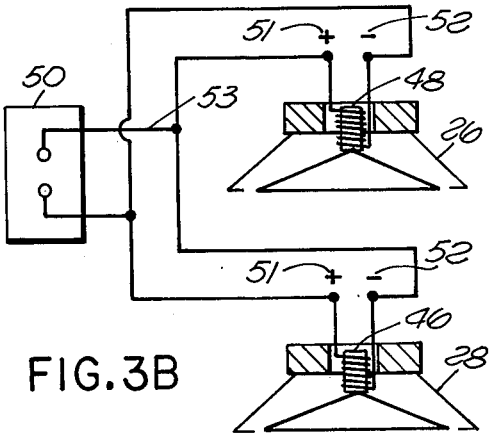

The two speakers 26 and 28 can also be interconnected in a parallel configuration as shown in FIG. 3B. A first output line 53 of the driving source 50 is connected to the positive terminal 51 of the upper speaker 26 and the negative terminal 52 of the lower speaker 28, the negative terminal 52 of the upper speaker 26 and positive terminal 51 of the lower speaker 28 being connected to each other and a return line 54 to the driving source 50. Both the serial and parallel wiring configurations shown in FIGS. 3A and 3B provide a means for the speakers to be operated simultaneously while being driven 180 degrees out-of-phase with respect to each other. The 180 phase mismatch is required so that a back emf generated by one speaker is also 180 degrees out-of-phase with a back emf generated by the other speaker, the back emf's canceling each other at the terminals of the driving source 50. This cancelation eliminates a feedback into the driving source 50 frequently experienced in conventional audio systems, and contributes to the quality of sound reproduction obtained by the speakers 26 and 28. Thus, one can appreciate that while undesired back emf signals are canceling each other, a backward movement of the rear surface 44 of the upper speaker diaphragm 34 which occurs during the forward movement of the front surface 38 of the lower speaker diaphragm 40 propagates a sound wave which combines and reinforces the sound wave propagated by the lower speaker 28, thereby resulting in an additive sound level with respect to a listener.

Figure 4:
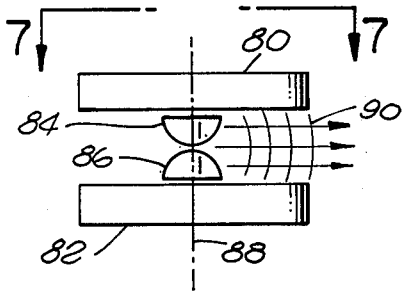
FIG. 4 is a cross sectional view showing two dome-type speakers configured according to a second embodiment of the invention.

Dome-type speakers capable of operation at mid-range and higher frequencies have recently become commercially available, these type of speakers being especially adaptable for practicing the principles of the subject invention in which active reflectors are utilized to obtain 360 degree, in-phase sound propagation. Referring to FIG. 4, an upper dome-type speaker 80 and a lower dome-type speaker 82 are mounted so that their respective domes 84 and 86 are adjacent to each other. Each dome is positioned so that its longitudinal axis is colinear with that of the other dome as represented at 88, although the axes could be angled with respect to each other to achieve special effects. The domes 84 and 86 are touching or are spaced apart less than two inches in the case of the mid-range speakers or less than one inch in the case of tweeters. It has been found that excellent results are obtained if the domes just touch each other at their maximum excursions during propagation of their highest frequency.

Figure 5:
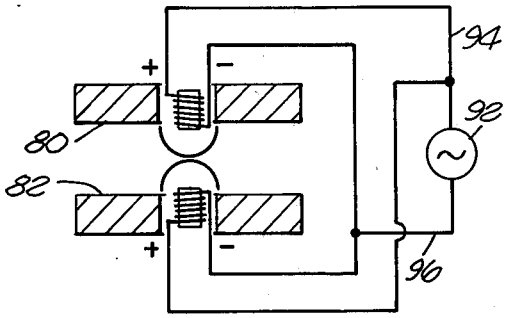
FIG. 5 is a schematic diagram showing wiring of the speakers shown in FIG. 4.
Figure 6:
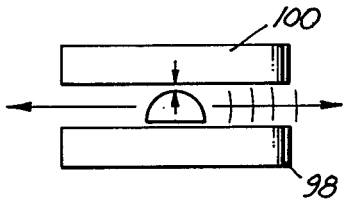
FIG. 6 is a third embodiment of the invention showing a dome-type speaker spaced adjacent to a flat reflecting surface.

The dome speakers 80 and 82 are operatively coupled to a driving means so that they operate in phase with each other, that is as the upper dome 84 is in a maximally extended condition the lower dome 86 is also in a maximally extended condition. As the speakers are driven in the above-described configuration and in phase with each other, sound wave propagation from each dome interacts with sound wave propagation from the other dome thereby producing sound waves propagating outwardly in a direction normal to the longitudinal axes of the domes as represented at 90, these waves being propagated in-phase and in a 360 degree pattern. These 360 degree, in-phase propagations provide sound having clarity and imaging characteristics heretofore unobtainable by conventional speaker systems. In-phase operation of the two dome speakers 80 and 82 can be achieved by wiring the speakers in parallel with a driving source 92. Referring to FIG. 5, the driving source 92 is connected so that a first output line 94 is connected to the positive terminals of each of the speakers 80 and 82, the negative terminals being interconnected via a return line 96. It has also been found that sound propagated from a single dome-type speaker 98, as shown in FIG. 6, will actively react with reflected sound from a plane reflecting surface 100 previously propagated by the dome-type speaker 98, the speaker being located at the above-prescribed distance. A speaker 98 and reflecting surface 100 as above-described provides a 360 degree, in-phase propagation pattern similar to that provided by the two dome configuration previously explained. In addition a parabolic reflecting surface, if focused within the prescribed distance as above described, will also provide an active reflector as required to practice the teachings of the invention.

Figure 7:
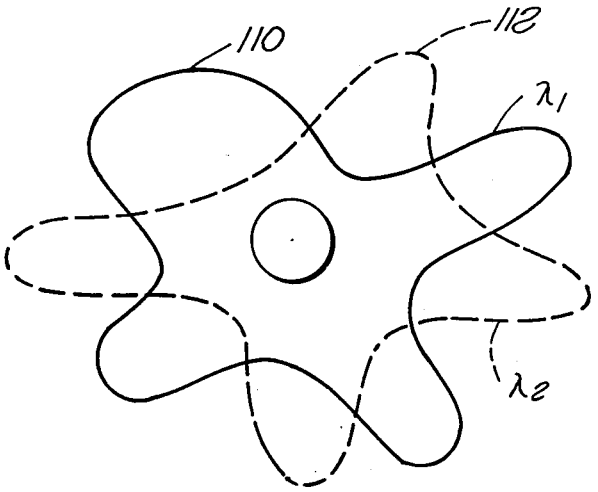
FIG. 7 is a top view taken along line 7—7 of FIG. 4 showing frequency dependent side lobes generated as a result of speakers being positioned according to the configuration shown in FIG. 4 and FIG. 6.

Utilizing the two-speaker configuration shown in FIG. 4, frequency dependent intensity lobes have been measured as shown in FIG. 7. The patterns of FIG. 7 are diagramatic only and are not representative of actual measurements taken either with respect to relative amplitudes or the number of lobes shown. However, it has been determined that the intensity of propagated sound energy at a predetermined distance from the sound source varies as a function of an azimuthal angle. For a predetermined propagation frequency $\lambda_1$, at a constant distance from the speakers 80, the intensity might vary as shown at 110. However, as the frequency changes to a second predetermined frequency $\lambda_2$, $|\lambda_1-\lambda_2|$ being relatively small, the side lobe orientation might change markedly as shown in phantom at 112. It is theorized that one contributor to the remarkable clarity and imaging apparent to a listener from speakers configured according to the present invention in this rapid change in frequency dependent intensity lobes as the frequency of the propagated sound waves varies. For example, as the frequency increases the frequency dependent lobes tend to rotate rapidly in a horizontal plane, this rapid rotation perhaps contributing to a realistic effect.

Figure 8:
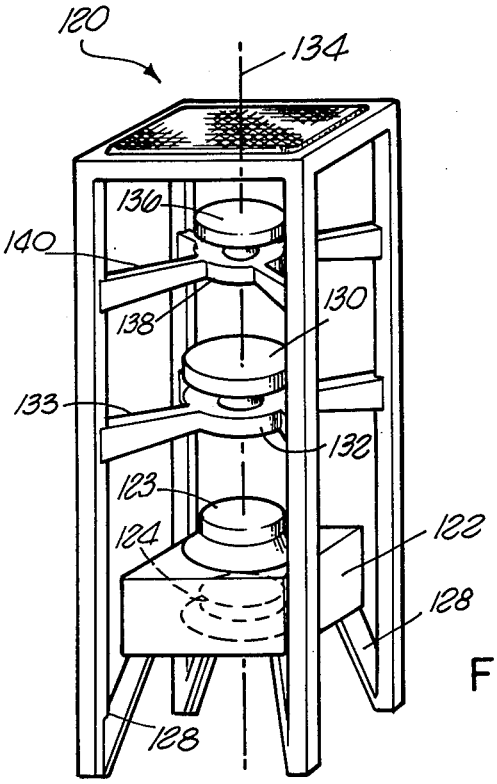
FIG. 8 is a speaker system incorporating bass, mid-range and tweeter speakers configured according to the invention.

A speaker system 120 containing woofers, mid-range speakers and tweeters configured according to the present invention is shown in FIG. 8. This speaker system 120 comprises a rectangularly shaped holding lattice 121 having a cube 122 mounted in its bottom. The cube 122 supports two woofers 123 and 124 in accordance with the FIG. 1 and FIG. 2 embodiment, the cube 122 bottom being spaced apart from the floor by four legs 128. Both speakers are wired to operate 180 degrees out-of-phase with respect to each other as previously explained. The speakers are mounted to the cube 122 so that their longitudinal axes are substantially vertical and colinear. The mid-range speaker system consists of two dome-type speakers comprising an upper speaker 130 and a lower speaker 132, both of which have their longitudinal axes colinear with those of the woofers 123 and 124. These speakers are attached to the holding lattice 121 by horizontal supporting arms 133. Likewise, a tweeter system consisting of two tweeter dome-type speakers 136 and 138 is also connected to the holding lattice 121 by horizontal supporting arms 140, the longitudinal axis of each dome-type speaker also being colinear respect to with the longitudinal axis of the speaker system 120 are represented at 134. Although separate dome-type speakers are shown for the tweeter speakers 136 and 138, and separate dome-type speakers are shown for the mid-range speakers 130 and 132, a single dome-type speaker pair mounted in accordance with the teachings of the invention could also be utilized. In operation, and as above discussed, the two woofers are driven out-of-phase with respect to each other whereas each dome-type speaker pair is driven in phase with each other. Two of the speaker systems 120 above described could be spaced apart for stereo operation, the combination of the two speaker systems providing sound reproduction having a realism heretofore unobtainable with conventional systems.

I claim:

1. An audio speaker set comprising: a bass unit comprising:

a casing having a first wall and a second wall, a first aperture through said first wall and a second aperture through said second wall;

a first bass speaker in said casing having concave front and convex rear sound propagating surfaces, said first speaker making sealing contact with said casing first aperture and mounted so that said front surface faces outwardly of said casing;

a second bass speaker acoustically coupled to said first bass speaker having concave front and convex rear sound propagating surfaces, said second speaker making sealing contact with said casing second aperture and mounted so that said front surface faces inwardly of said casing, said casing, first speaker and second speaker forming a substantially air-tight chamber; and means for operating said speakers 180 degrees out of phase with each other so that said speaker surfaces in reactive contact with air within said air chamber alternately compress and rarefy said chamber air;

a high frequency unit comprising:

a first dome-type speaker having a forward surface for alternately compressing and rarefying air;

a second dome-type speaker having a forward surface, facing the forward surface of said first dome-type speaker, for alternately compressing and rarefying air, said second speaker forward surface being positioned from touching said first speaker forward surface to less than two inches therefrom;

means for operating said first and second dome-type speakers substantially in phase with each other; and means for mounting said bass unit and said high frequency unit so that the longitudinal axes of said bass speakers and said dome-type speakers are substantially colinear.

2. The speaker configuration of claim 1 in which said first and second dome-type speakers are mid-range speakers, said high frequency unit further comprising:

a third dome-type high frequency speaker having a forward surface for alternately compressing and rarefying air;

a fourth dome-type high frequency speaker having a forward surface, facing the forward surface of said third dome-type speaker, for alternately compressing and rarefying air, said fourth speaker forward surface being positioned from touching said third dome-type speaker forward surface to less than one inch therefrom;

means for orienting said third and fourth dome-type speakers so that their longitudinal axes are colinear with the longitudinal axes of said second dome-type speaker;

means for operating said third and fourth speakers substantially in phase with each other.

3. The speaker configuration of claim 2 in which said casing comprises a plurality of legs for supporting said casing spaced from said floor.

* * * * *